US008873979B2

(12) United States Patent
Fujiwara et al.

(10) Patent No.: US 8,873,979 B2
(45) Date of Patent: Oct. 28, 2014

(54) DEVELOPMENT DEVICE, PROCESS CARTRIDGE, AND IMAGE FORMING APPARATUS INCORPORATING SAME

(75) Inventors: Yoshihiro Fujiwara, Kanagawa (JP); Kunihiro Ohyama, Tokyo (JP); Masayuki Yamane, Kanagawa (JP); Hideki Kimura, Kanagawa (JP); Masaki Takahashi, Kanagawa (JP); Toshiki Hayashi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 26 days.

(21) Appl. No.: 13/355,020

(22) Filed: Jan. 20, 2012

(65) Prior Publication Data

US 2012/0207492 A1 Aug. 16, 2012

(30) Foreign Application Priority Data

Feb. 14, 2011 (JP) ..... 2011-029056

(51) Int. Cl.
*G03G 15/08* (2006.01)

(52) U.S. Cl.
CPC ..... *G03G 15/0893* (2013.01); *G03G 2215/069* (2013.01); *G03G 15/0849* (2013.01)
USPC ..... 399/30

(58) Field of Classification Search
CPC ..... G03G 15/09
USPC ..... 399/30, 254, 267, 277, 61, 258, 359
See application file for complete search history.

(56) References Cited

U.S. PATENT DOCUMENTS 5,214,476 A * 5/1993 Nomura et al. ..... 399/30
5,722,002 A * 2/1998 Kikuta et al. ..... 399/30
6,526,252 B1 * 2/2003 Itoh et al. ..... 399/359
7,558,496 B2 * 7/2009 Watanabe ..... 399/62
7,974,556 B2 7/2011 Hori et al.
2007/0127934 A1 * 6/2007 Shoji et al. ..... 399/9
2007/0196116 A1 * 8/2007 Watanabe ..... 399/30
2008/0199223 A1 * 8/2008 Tateyama et al. ..... 399/254
2009/0232526 A1 * 9/2009 Yoneda et al. ..... 399/30
2009/0238610 A1 * 9/2009 Miyoshi et al. ..... 399/267
2010/0003055 A1 1/2010 Kikuchi et al.
2010/0129118 A1 5/2010 Kimura et al.
2010/0202805 A1 8/2010 Miyoshi et al.

(Continued)

FOREIGN PATENT DOCUMENTS

JP 2005-31119 2/2005
JP 2007-34043 2/2007
JP 2010-217328 9/2010

*Primary Examiner* — Clayton E Laballe
*Assistant Examiner* — Kevin Butler
(74) *Attorney, Agent, or Firm* — Oblon, Spivak, McClelland, Maier & Neustadt, L.L.P.

(57) ABSTRACT

A development device includes a developer container for containing developer, a developer bearer to carry by rotation the developer contained in the developer container to a development range facing a latent image bearer, a partition dividing the developer container into an upper compartment and a lower compartment arranged vertically, an upper developer conveyance member disposed in the upper compartment, a lower developer conveyance member disposed in the lower compartment, a communication portion through which the developer moves from the lower compartment to the upper compartment, disposed in a downstream end portion of the lower compartment in a direction in which the lower developer conveyance member transports the developer, and a toner concentration detector to detect a concentration of toner in the developer beneath the communication portion inside the lower compartment.

14 Claims, 8 Drawing Sheets

(56) References Cited

U.S. PATENT DOCUMENTS

| | | | | |
|---|---|---|---|---|
| 2010/0215401 | A1 | 8/2010 | Fujiwara et al. | |
| 2011/0008073 | A1 | 1/2011 | Kudo et al. | |
| 2011/0058857 | A1 | 3/2011 | Hori et al. | |
| 2011/0150525 | A1 | 6/2011 | Fujiwara et al. | |
| 2011/0222871 | A1 | 9/2011 | Suzuki et al. | |
| 2012/0051793 | A1* | 3/2012 | Kudo et al. | 399/254 |
| 2012/0207492 | A1* | 8/2012 | Fujiwara et al. | 399/30 |

* cited by examiner

DEVELOPMENT DEVICE, PROCESS CARTRIDGE, AND IMAGE FORMING APPARATUS INCORPORATING SAME

CROSS-REFERENCE TO RELATED APPLICATIONS

This patent application is based on and claims priority pursuant to 35 U.S.C. §119 to Japanese Patent Application No. 2011-029056, filed on Feb. 14, 2011, in the Japan Patent Office, the entire disclosure of which is hereby incorporated by reference herein.

FIELD OF THE INVENTION

The present invention generally relates to a development device, a process cartridge, and an image forming apparatus, such as a copier, a printer, a facsimile machine, or a multifunction machine having at least two of these capabilities, that includes a development device.

BACKGROUND OF THE INVENTION

Image forming apparatuses typically include a development device to develop latent images formed on a photoreceptor with developer, and two-component developer consisting essentially of toner (toner particles) and magnetic carrier (carrier particles) is widely used in image forming apparatuses. Development devices typically include a development roller serving as a developer bearer and a developer conveyance member to transport the developer inside the development device. Toner in the developer contained in such development devices is consumed in image development, and a toner supply device supplies toner to the development device as required, thereby keeping the concentration of toner in the developer in the development device within a predetermined range.

If the concentration of toner in developer is lower than the predetermined range, image density becomes insufficient, and it is possible that lines or letters in output images become thinner and fade. By contrast, if the concentration of toner in developer is higher, image density becomes excessive, and it can cause bulging of lines and letters or scattering of toner in the backgrounds of output images. Moreover, desired hue cannot be attained if concentrations of respective color toners fluctuate in multicolor image forming apparatuses that use multiple development devices and form multicolor images by superimposing single-color images one on another.

In view of the foregoing, it is necessary to detect the concentration of toner in the developer in the development device and control supply of toner to the development device. For example, concentration of toner in two-component developer can be detected based on magnetic permeability of the developer since magnetic permeability of the developer changes as the concentration of toner therein changes as proposed in JP-2007-034043-A and JP-2010-217328-A.

There are image forming apparatuses that use different processing velocities, that is, the number of copies per minute (CPM). In such image forming apparatuses, the rotational velocity of the development roller of the development device is varied in accordance with the CPM. For example, the developer conveyance member is a conveyance screw including a rotary shaft and spiral-shaped blade winding around the shaft, and transports developer axially by rotation. When the conveyance screw and the development roller are driven by a common drive source, the rotational velocity of the conveyance screw changes as the rotational velocity of the development roller is changed.

In such a configuration, depending on the position where the toner concentration detector detects the toner concentration (i.e., toner concentration detection position), it is possible that changes in the rotational velocity of the conveyance screw affect the magnetic permeability detected. More specifically, the detected magnetic permeability decreases as the rotational velocity of the conveyance screw increases.

BRIEF SUMMARY OF THE INVENTION

In view of the foregoing, one embodiment of the present invention provides a development device including a developer container for containing two-component developer, a developer bearer to carry by rotation the developer contained in the developer container to a development range facing a latent image bearer, a partition dividing at least partly the developer container into an upper compartment and a lower compartment arranged vertically, an upper developer conveyance member disposed in the upper compartment to transport the developer inside the upper compartment, a lower developer conveyance member disposed in the lower compartment to transport the developer inside the lower compartment, a communication portion through which the developer moves from the lower compartment to the upper compartment, and a toner concentration detector to detect a concentration of toner in the developer inside the lower compartment. The communication portion is disposed in a downstream end portion of the lower compartment in a direction in which the lower developer conveyance member transports the developer. A detection position of the toner concentration detector is positioned beneath the communication portion between the upper compartment and the lower compartment.

In another embodiment, an image forming apparatus includes a latent image bearer on which a latent image is formed, and the development device described above.

Yet in another embodiment, the latent image bearer and the development device described above are housed in a common unit casing as a process cartridge removably installable in an image forming apparatus.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
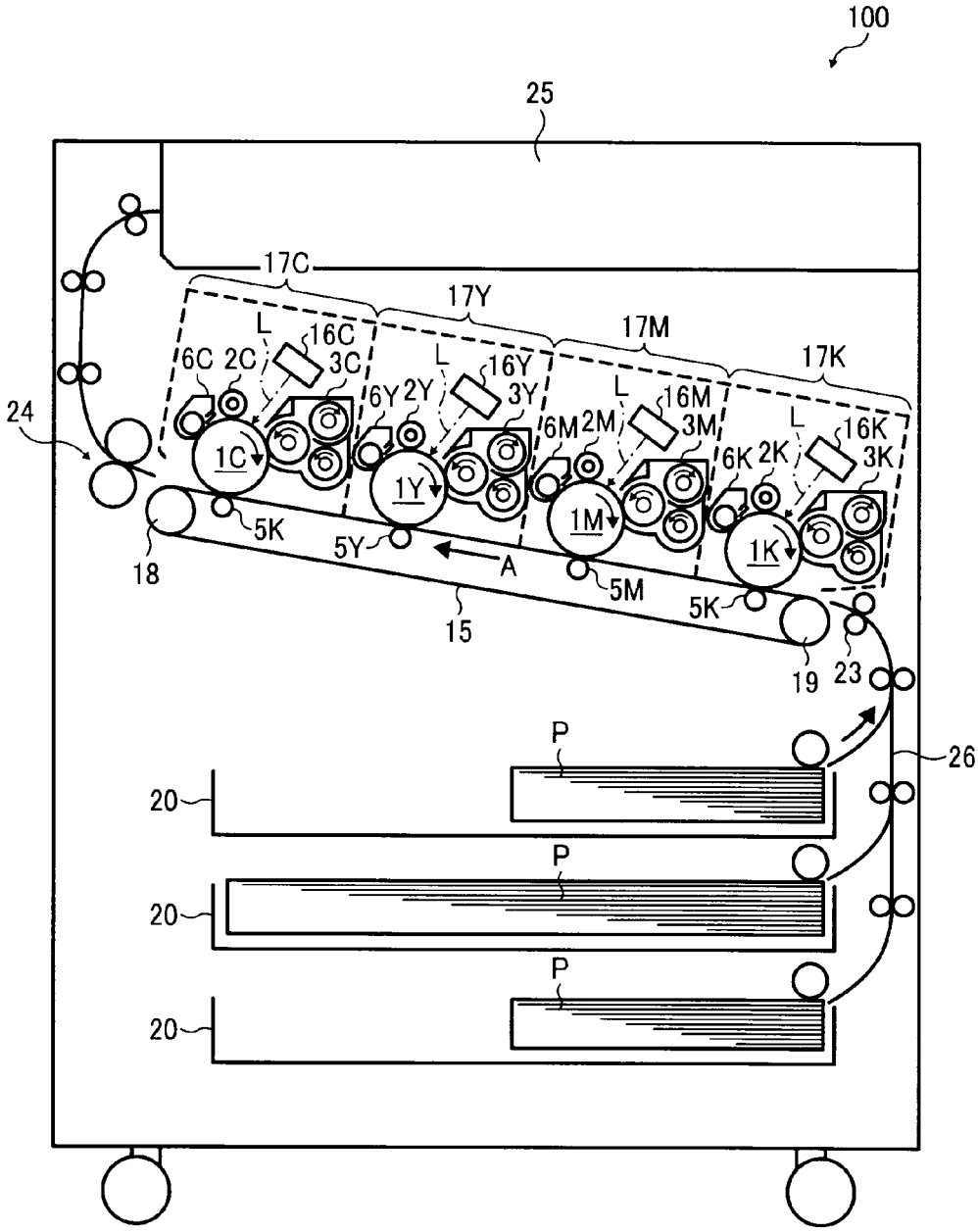
FIG. 1 is a schematic diagram of an image forming apparatus according to an embodiment.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a multicolor image forming apparatus according to an embodiment of the present invention is described.

It is to be noted that the suffixes Y, M, C, and K attached to each reference numeral indicate only that components indicated thereby are used for forming yellow, magenta, cyan, and black images, respectively, and hereinafter may be omitted when color discrimination is not necessary.

FIG. 1 is a schematic diagram illustrates a configuration of an image forming apparatus 100 that in the present embodiment is a printer.

The image forming apparatus 100 is a tandem-type multicolor image forming apparatus and includes four image forming units 17K, 17M, 17Y, and 17C for forming black (K), magenta (M), yellow (Y), and cyan (C) single-color toner images, respectively. An endless transfer-transport belt 15 winding around support rollers 18 and 19 is provided beneath the image forming units 17. An upper side of the transfer-transport belt 15 rotates in a direction indicated by arrow A shown in FIG. 1 (hereinafter "belt travel direction") while carrying a sheet P (recording medium) thereon. Transfer bias rollers 5K, 5M, 5Y, 5C are provided facing the respective image forming units 17K, 17M, 17Y, and 17C via the transfer-transport belt 15.

The image forming apparatus 100 further includes a fixing device 24, disposed downstream from the downstream support roller 18 in the belt travel direction, and a discharge tray 25 formed on an upper side of the main body of the image forming apparatus 100. The fixing device 24 fixes a toner image on the sheet P thereon after the sheet P is separated from the transfer-transport belt 15, after which the sheet P is discharged onto the discharge tray 25.

The image forming apparatus 100 further includes multiple sheets cassettes 20 each containing multiple sheets P, a feed unit 26 to feed the sheets P from the sheets cassettes 20 to the image forming units 17, and a pair of registration rollers 23. The registration rollers 23 forward the sheet P sent from one of the sheet cassettes 20, timed to coincide with image formation by the image forming units 17.

It is to be noted that, in the configuration shown in FIG. 1, the transfer-transport belt 15 is disposed obliquely to reduce the width of the image forming apparatus 100, that is, its lateral length in FIG. 1, and accordingly the belt travel direction indicated by arrow A is oblique. With this configuration, the width of the image forming apparatus 100 can be only a length slightly greater than the length of A3 sheets in their longitudinal direction. In other words, the width of the image forming apparatus 100 can be significantly reduced to a length only necessary to contain sheets.

Each image forming unit 17 includes a drum-shaped photoreceptor 1 serving as a latent image bearer. Around the photoreceptor 1, a charger 2 to charge a surface of the photoreceptor 1, a development device 3 to develop an electrostatic latent image formed on the photoreceptor 1, and a cleaning unit 6 to clean the surface of the photoreceptor 1 are provided. An exposure unit 16 directs writing light (e.g., a writing beam) L onto the surface of each photoreceptor 1 between the charger 2 and the development device 3. Thus, each image forming unit 17 has a known configuration. As the photoreceptor 1, belt-shaped photoreceptors may be used instead of drum-shaped photoreceptors.

In the above-described image forming apparatus 100, when users instruct the apparatus to start image formation, each image forming unit 17 starts to form a single-color toner image. More specifically, in each image forming unit 17, the photoreceptor 1 is rotated by a main motor and is charged uniformly at a position facing the charger 2 as the charging process. Then, the exposure unit 16 directs the writing beam L onto the photoreceptor 1 according to yellow, cyan, magenta, or black image data decomposed from multicolor image data, thus forming an electrostatic latent image thereon. The latent image is then developed by the development device 3. Thus, single-color toner images are formed on the respective photoreceptors 1. While the processes described above are performed, the sheets P are fed one by one from one of the sheet cassettes 20 by the feed unit 26 to the registration rollers 23, which forward the sheet P to the transfer-transport belt 15, timed to coincide with the arrival of the toner images formed on the respective photoreceptors 1. Then, the transfer-transport belt 15 transports the sheet P to the respective transfer positions.

When the surface of each photoreceptor 1 carrying the toner image reaches a position facing the transfer bias roller 5 via the transfer-transport belt 15, the toner image is transferred by the bias applied by the transfer bias roller 5 from the photoreceptor 1 onto the sheet P on the transfer-transport belt 15. Thus, the black, magenta, yellow, and cyan toner images are sequentially transferred from the respective photoreceptors 1 and superimposed one on another on the sheet P, forming a multicolor toner image on the sheet P. The sheet P on which the multicolor toner image is formed is then separated from the transfer-transport belt 15, and the fixing device 24 fixes the image on the sheet, after which the sheet P is discharged onto the discharge tray 25.

After the toner image is transferred from each photoreceptor 1, the cleaning unit 6 removes any toner remaining thereon, and a discharge lamp removes electrical potentials remaining on the photoreceptor 1 as required. Then, the charger 2 again charges the surface of the photoreceptor 1.

Although the image forming units 17K, 17M, 17Y, and 17C are arranged in that order in the belt travel direction in the configuration shown in FIG. 1, the order of arrangement is not limited thereto. For example, the image forming unit 17K for black may be disposed extreme downstream in the belt travel direction, and the image forming units 17M, 17Y, and 17C may be disposed in that order upstream from the image forming unit 17K.

The image forming units 17 are described in further detail below. The development devices 3K, 3M, 3Y, and 3C have a similar configuration except that the color of the toner used therein is different. Therefore, subscripts K, M, Y, and C attached to reference numerals are omitted in the description below.

Figure 2:
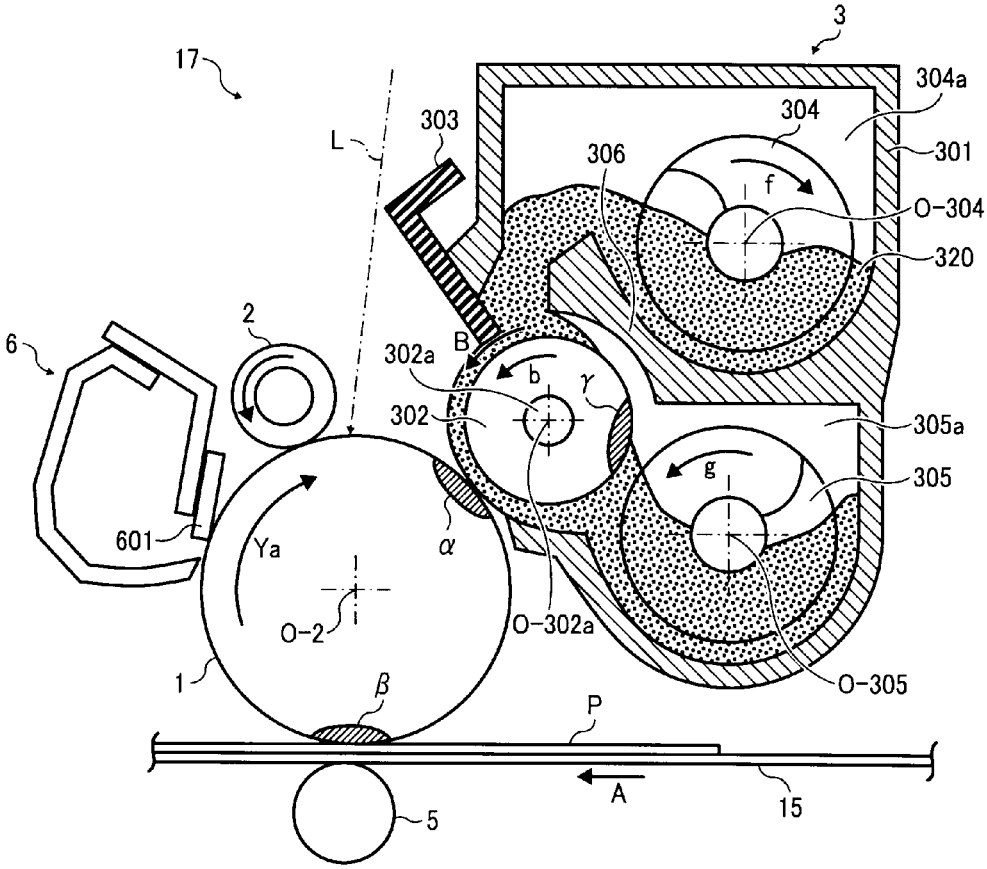
FIG. 2 is a schematic end-on axial view of an image forming unit.

FIG. 2 is a schematic end-on axial view of the development device 3 usable in the image forming apparatus 100 in the present embodiment.

The development device 3 is disposed facing the photoreceptor 1 that rotates clockwise, that is, in the direction indicated by arrow Ya, in FIG. 2.

The charger 2 is positioned above the photoreceptor 1, substantially at eleven o'clock of the photoreceptor 1 in FIG. 2. Although the charger 2 in the present embodiment is a rotary body rotating at an identical velocity to that of the photoreceptor 1, alternatively, a corona discharge-type charger may be used.

After the charger 2 charges the circumferential surface of the photoreceptor 1 uniformly in the dark, the exposure unit 16 directs the optical beam L to the photoreceptor 1, thus forming an electrostatic latent image thereon. As the photoreceptor 1 rotates, the electrostatic latent image formed thereon moves downstream to the development device 3, which is on the right of the photoreceptor 1 in the configuration shown in FIG. 2.

The development device 3 includes a casing 301 serving as a developer container for containing developer 320, divided by a partition 306 at least partly into a supply compartment 304*a* and a collecting compartment 305*a*, a development roller 302, and developer conveyance members 304 and 305 to agitate the developer 320, provided in the supply compartment 304*a* and the collecting compartment 305*a*, respectively. The supply compartment 304*a* and the collecting compartment 305*a* are developer conveyance compartments or developer conveyance paths.

The development roller 302 is adjacent to the photoreceptor 1 at a position between two o'clock to three o'clock of the photoreceptor 1 in FIG. 2, and thus a development range α is formed therebetween. An opening is formed in the casing 301 at the position facing the photoreceptor 1, exposing the development roller 302.

As the development roller 302 rotates in the direction indicated by arrow b shown in FIG. 2, the developer 320 contained in the casing 301 is carried on the surface of the development roller 302 and transported to the development range α as indicated by arrow B. In the development range α, toner in the developer 320 adheres to the electrostatic latent image formed on the surface of the photoreceptor 1, thus developing it into a toner image.

As the photoreceptor 1 rotates, the toner image further moves downstream in the direction of rotation of the photoreceptor 1 to a transfer area β facing the transfer bias roller 5. The transfer bias roller 5 is positioned beneath the photoreceptor 1 at six o'clock of the photoreceptor 1 in FIG. 2. Although the transfer mechanism of the present embodiment uses rotators, namely, the transfer bias rollers 5, alternatively, a corona discharge-type transfer mechanism may be used.

In the transfer area β, the toner image is transferred from the photoreceptor 1 onto the sheet P. In the present embodiment, the toner image formed on the photoreceptor 1 is transferred directly to the sheet P. It is to be noted that the development device according to the present embodiment can adapt to intermediate transfer-type image forming apparatuses that primarily transfer toner images from the photoreceptors and superimpose them one on another on an intermediate transfer member (e.g., intermediate transfer belt), forming a multicolor toner image, after which the superimposed toner image is transferred onto a sheet at a time. In this case, the toner image formed on the photoreceptor 1 is transferred onto the intermediate transfer member in the transfer area β.

Subsequently, the surface of the photoreceptor 1 that has passed through the transfer area β reaches a position facing the cleaning unit 6 as the photoreceptor 1 rotates.

The cleaning unit 6 is positioned at ten o'clock of the photoreceptor 1 in FIG. 2. The cleaning unit 6 includes a cleaning blade 601 for removing any toner remaining on the circumferential surface of the photoreceptor 1 after the toner image is transferred therefrom onto the sheet P in the transfer area β. The circumferential surface of the photoreceptor 1 that has passed through the range facing the cleaning unit 6 is again charged by the charger 2 uniformly. Then, image formation is repeated.

Next, the development device 3 is described in further detail below.

As shown in FIG. 2, the development device 3 includes the development roller 302, the developer conveyance members 304 and 305, and a developer regulator 303, which are provided inside the casing 301. The developer 320 is circulated inside the casing 301.

In the present embodiment, the developer conveyance members 304 and 305 are, for example, conveyance screws each including a rotary shaft and spiral-shaped blade winding around the shaft to transport developer axially by rotation. The external diameter of the spiral blade is smaller than about 16 mm, for example.

It is to be noted that, in FIG. 2, reference characters 302*a* represents a stationary shaft of the development roller 302, O-2 represents a center of rotation of the photoreceptor 2, and O-302*a* represents a center of rotation of the development roller 302. Additionally, reference characters O-304*a* and O-305*a* represent centers of rotation of the developer conveyance members 304 and 305, respectively. Further, reference character γ represents a developer separation range, and c represents a developer retaining portion.

Figure 3:
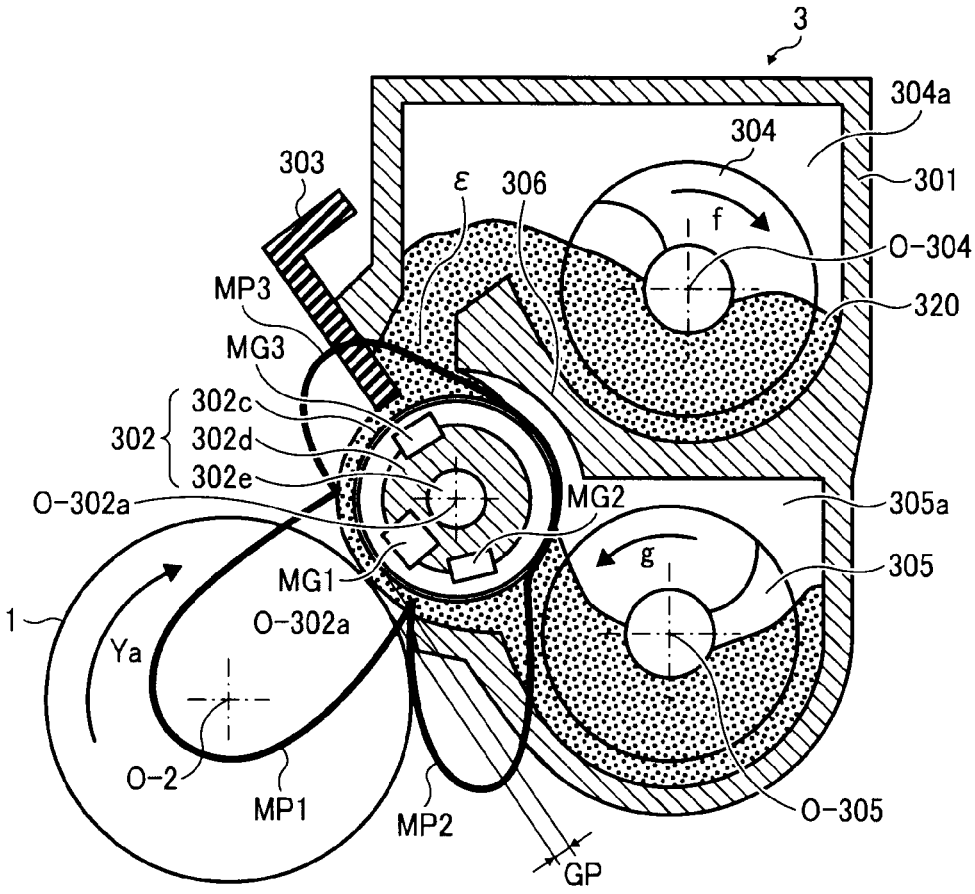
FIG. 3 is an end-on axial view of a development device and a photoreceptor, and distribution of magnetic flux density in normal direction is superimposed on it.

FIG. 3 is an end-on axial view of the development device 3 and the photoreceptor 1, and distribution of magnetic flux density in normal direction formed around the development roller 302 is superimposed on it.

As shown in FIG. 3, a magnet roller 302*d* is provided inside the development roller 302, and its position is fixed relative to the development device 3. The magnet roller 302*d* includes multiple magnets MG1, MG2, and MG3 (also collectively "magnets MG") arranged in the circumferential direction thereof, and a cylindrical sleeve 302*c* provided outside the magnet roller 302*d* rotates together with a rotary shaft 302*e*.

The sleeve 302*c* is formed of nonmagnetic metal such as aluminum although other materials may be included therein. The magnet roller 302*d* is fixed to a stationary member such as the casing 301 so that the magnets MG face predetermined directions. As the sleeve 302*c* rotates around the magnet roller 302*d*, the developer 320 is attracted to the magnets MG and carried by the sleeve 302*c*.

Figure 4:
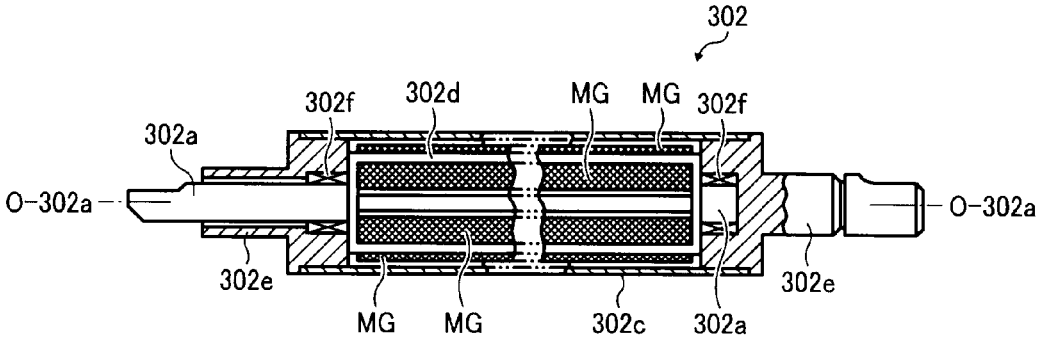
FIG. 4 is a cross-sectional view of a development roller in parallel to its axis.

FIG. 4 is a cross-sectional view of the development roller 302 in parallel to its rotary axis.

As shown in FIG. 4, the development roller 302 includes the stationary shaft 302*a* fixed to the casing 301, the cylindrical magnet roller 302*d* united to the stationary shaft 302*a*, the sleeve 302*c* overlaying the magnet roller 302*d* across a gap, and the rotary shaft 302*e* united to the sleeve 302*c*. The rotary shaft 302*e* is rotatable relative to the stationary shaft 302*a* via bearings 302*f*, driven by a driving unit.

As shown in FIG. 4, the multiple magnets MG are fixed to an outer circumferential surface of the magnet roller 302*d* and arranged at predetermined intervals. The sleeve 302*c* is designed to rotate around the magnets MG.

The magnets MG arranged in the magnet roller 302*d* form magnetic fields to cause the developer 302 to stand on end on the circumferential surface of the sleeve 302*c* and to separate the developer 320 from the sleeve 302*c*. The magnetic carrier particles gather along the magnetic force lines in normal direction generated by the magnets MG; forming magnetic brushes.

Although other configuration can be adopted, the magnet roller 302*d* in the present embodiment includes three magnets MG positioned inside the sleeve 302*c* and generates three magnetic poles MP, namely, a development pole MP1, a magnetic pole MP2, and a regulation pole MP3 as shown in FIG. 3.

As shown in FIG. 3, the magnet MG1 is positioned on the line passing through the center of rotation O-302*a* of the development roller 302 as well as a center of rotation O-2 of the photoreceptor 1 and faces the photoreceptor 1. Thus, the magnet MG1 forms the development pole MP1 in the development range α, that is, the development pole MP1 faces the photoreceptor 1. The magnets MG1, MG2, and MG3 are arranged counterclockwise in FIG. 3. The magnet MG2 forms the magnetic pole MP2, which faces the casing 301, and the magnet MG3 forms the regulation pole MP3, which faces the developer regulator 303.

In the present embodiment, the development pole MP1 is a north (N) pole, and the magnetic pole MP2 and the regulation pole MP3 are south (S) poles although the polarities can be reversed.

In the development range α, the surface of the development roller 302 is not in direct contact with the surface of the photoreceptor 1. Thus, a development gap GP having a predetermined distance suitable for image development is kept between the development roller 302 and the photoreceptor 1. Developer particles are caused to stand on end on the circumferential surface of the development roller 302 and brought into contact with the surface of the photoreceptor 1. Thus, toner particles can adhere to the electrostatic latent image formed thereon, developing it.

The stationary shaft 302*a* of the development roller 302 receives a development bias from a power source grounded and connected to the stationary shaft 302*a*. Voltage supplied from the power source connected to the stationary shaft 302*a* is applied to the sleeve 302*c* via the electroconductive bearings 302*f* and the electroconductive rotary shaft 302*e*. By contrast, an electroconductive support body that forms an innermost layer of the photoreceptor 1 is grounded. With this configuration, an electrical field for conveying toner particles separated from carrier particles toward the photoreceptor 1 is formed in the development range α, and accordingly the toner particles move toward the photoreceptor 1 due to differences in electrical potential between the sleeve 302*c* and the electrostatic latent image formed on the surface of the photoreceptor 1.

The development device 3 according to the present embodiment is used in image forming apparatuses that optically write latent images with the writing lights L on the photoreceptors 1 as shown in FIGS. 1 and 2. More specifically, the charger 2 charges the photoreceptor 1 uniformly to a negative electrical potential, and an image portion on which an image is to be formed is exposed with the writing light L so as to reduce the negative electrical potentials. Then, the image portion (an electrostatic latent image) that has a reduced electrical potential is developed with negative toner, which is a method so-called "reversal development". It is to be noted that charging potentials of the photoreceptor 1 can be either negative or positive in configurations to which the features of this specification are applicable.

As the sleeve 302*c* rotates, the developer 320 on the surface of the sleeve 302*c* that has passed through the development range α, attracted thereto by the magnetic pole MP2, is conveyed downstream and is collected in the casing 301.

The magnetic pole MP2 and the regulation pole MP3 have the same polarity, and no magnetic field for causing the developer 320 to stand on end is formed on the surface of the sleeve 302*c* downstream from the position facing the magnetic pole MP2 and upstream from the position facing the regulation pole MP3 in the direction of rotation of the sleeve 302*c*. Therefore, in this range, the developer 320 does not stand on end but lies on the sleeve 302*c*, and there are effects to facilitate separation of the developer 320 that has been attracted to the sleeve 302*c* from the development roller 302. As shown in FIG. 3, in the range downstream from the position facing the magnetic pole MP2 and upstream from the position facing the regulation pole MP3, the peak of distribution of magnetic flux density in normal direction is significantly lower than that in other ranges. Thus, this range serves as the developer separation range γ (shown in FIG. 2) to separate the developer 320 from the sleeve 302*c*.

The concentration of toner in the developer 320 decreases after the toner therein moves to the photoreceptor 1. Therefore, desired image density might not be attained if such developer 320 having a reduced toner concentration is not separated from the development roller 302 but is transported again to the development range a (hereinafter "carryover of developer") and used in image development.

To prevent carryover of developer, after passing through the development range α, the developer 320 is separated from the sleeve 302*c* of the development roller 302 in the developer separation range γ. The developer separated from the development roller 302 is collected in the collecting compartment 305*a* and mixed with the developer in the casing 301 so that the developer has a desired toner concentration and a desired amount of electrical charges. Subsequently, the developer 320 is supplied from the supply compartment 304*a* by the developer conveyance member 304 to the developer retaining portion ϵ. From the developer retaining portion ϵ, the developer 320 is attracted to the sleeve 302*c* by the magnetic force exerted by the regulation pole MP3 and transported through the portion facing the developer regulator 303, which is positioned immediately downstream from the peak position of the regulation pole MP3. Thus, the amount (layer thickness) of the developer carried on the sleeve 302*c* is adjusted. Then, the developer 302 forms a magnetic brush and is transported to the development range α. The regulation pole MP3 serves as a conveyance pole to transport the developer 320.

Figure 5:
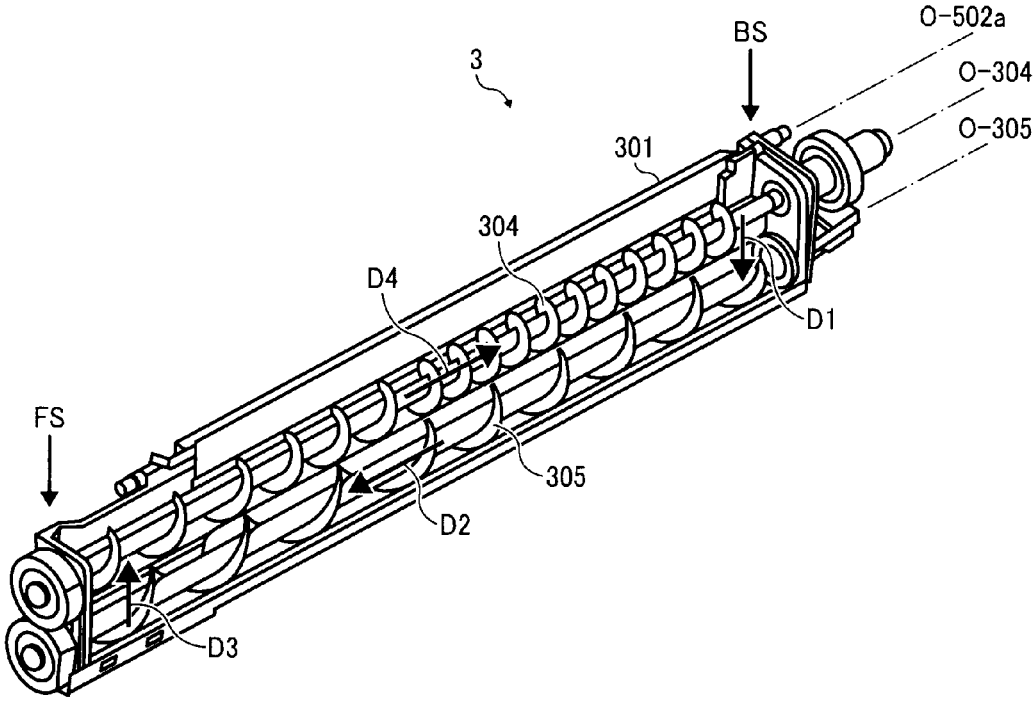
FIG. 5 is a perspective view illustrating an interior of the development device.
Figure 6:
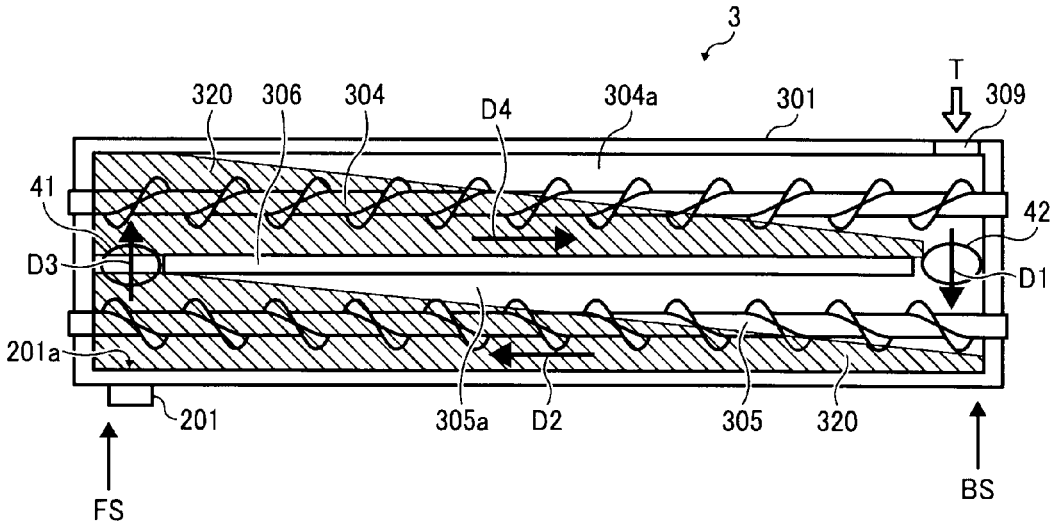
FIG. 6 is a cross-sectional view of a development device according to an embodiment.
Figure 7:
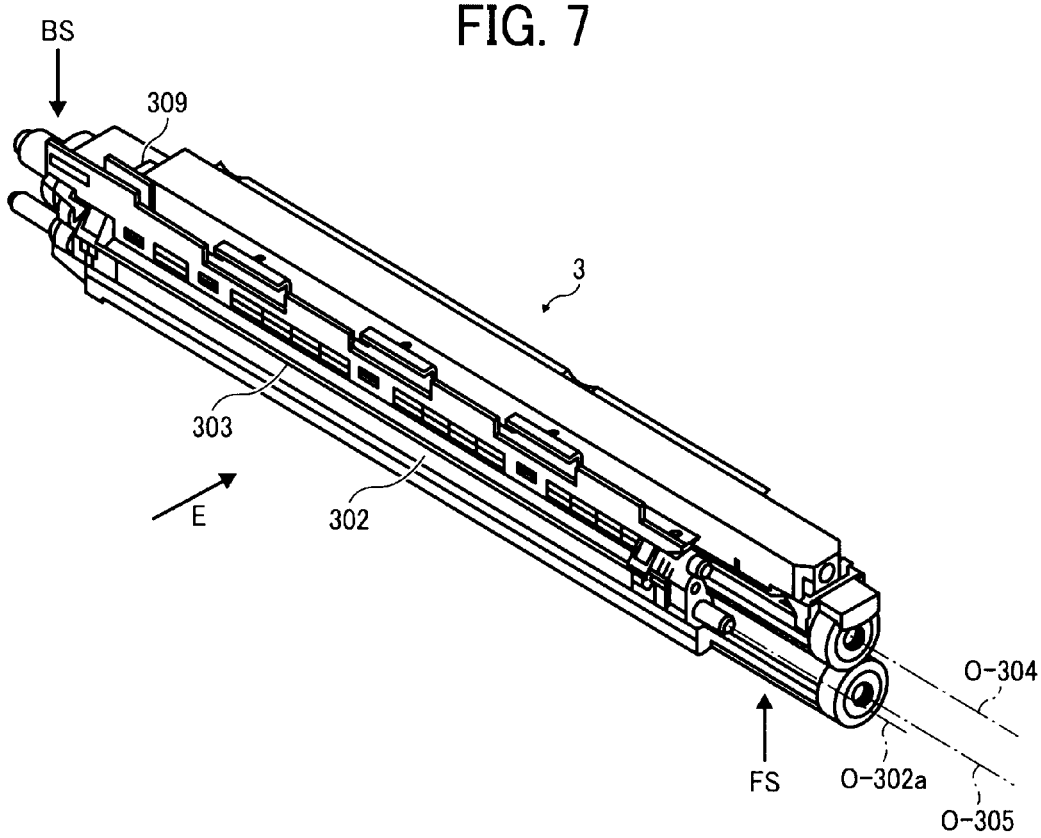
FIG. 7 is a perspective view illustrating an exterior of the development device.

FIG. 5 is a perspective view that illustrates an interior of the development device 3, and FIG. 6 is a cross-sectional view of the development device 3 as viewed in the direction indicated by arrow E shown in FIG. 7. Arrows D1 to D4 shown in FIGS. 5 and 6 represent flow of the developer 320 in the casing 301. It is to be noted that, in FIG. 6, reference numeral 309 represents a toner supply inlet, 201 represents a toner concentration detector, and reference character 201*a* represents a detection area.

The developer conveyance member 304 is positioned adjacent to the development roller 302 and at two o'clock of the development roller 302 in FIGS. 2 and 3, which is upstream from the position facing the developer regulator 303 in the direction of rotation of the development roller 302. As shown in FIGS. 5 and 6, the developer conveyance member 304 is screw-shaped and includes the spiral blade winding around the rotary shaft. The developer conveyance member 304 rotates clockwise as indicated by arrow f shown in FIGS. 2 and 3 around the center of rotation (or centerline) O-304 that is in parallel to the center of rotation (or centerline) O-302*a* of the development roller 302. Referring to FIG. 5, with this rotation, the developer 320 is transported from a proximal side FS to a distal side BS in the longitudinal direction of the development device 3 along the center of rotation O-304 as indicated by arrow D4. That is, the developer conveyance member 304 transports the developer 320 axially from the proximal side FS to the distal side BS when a driving force is inputted to the rotary shaft thereof.

The developer conveyance member 305 is positioned adjacent to the development roller 302 and at four o'clock of the development roller 302 close to the developer separation range γ in FIGS. 2 and 3. As shown in FIGS. 5 and 6, the developer conveyance member 305 is also screw-shaped and includes the spiral blade winding around the rotary shaft. The developer conveyance member 305 rotates clockwise as indicated by arrow g shown in FIGS. 2 and 3 around the center of rotation O-305 that is in parallel to the center of rotation O-302*a* of the development roller 302.

With this rotation, the developer 320 is transported from the distal side BS to the proximal side FS in the longitudinal direction of the development device 3 along the center of rotation (centerline) O-305 as indicated by arrow D2. That is, when a driving force is inputted to the rotary shaft thereof, the developer conveyance member 305 transports the developer 320 axially from the distal side BS to the proximal side FS in the direction opposite the direction in which the developer conveyance member 304 transports the developer 320.

Inside the casing 301, the supply compartment 304*a*, in which the developer conveyance member 304 is provided, is positioned above and adjacent to the collecting compartment 305*a*, in which the developer conveyance member 305 is provided, via the partition 306.

Figure 8:
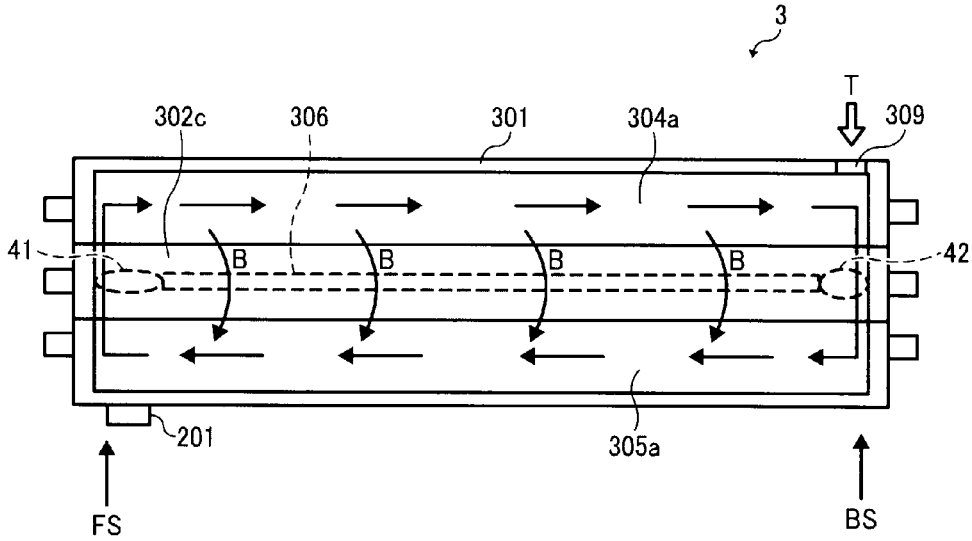
FIG. 8 illustrates flow of developer in a developer container in the development device.
Figure 9:
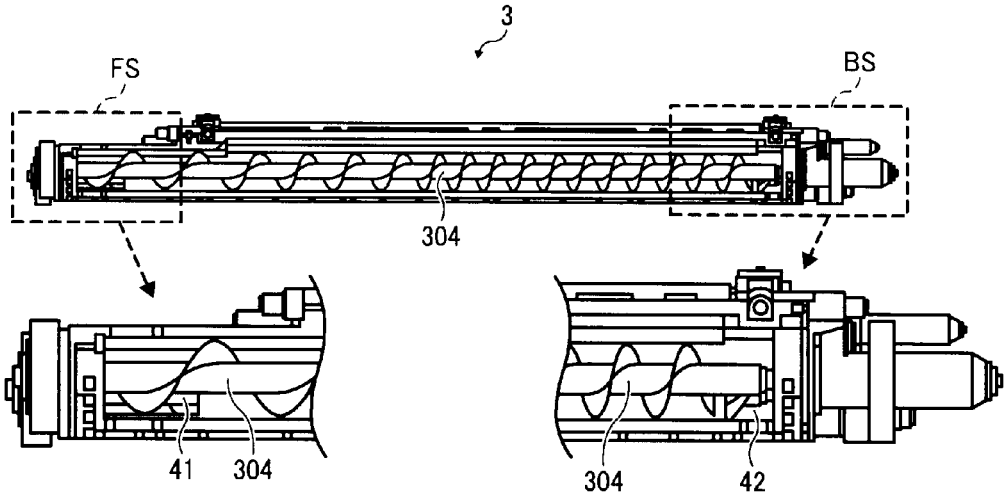
FIG. 9 illustrates communication portions formed in the development device.

FIG. 7 is a perspective view that illustrates an exterior of the development device 3. FIG. 8 illustrates a flow of the developer 320 in the casing 301 as viewed in the direction indicated by arrow E shown in FIG. 7. FIG. 9 illustrates from above communication portions or openings 41 and 42 (shown in FIGS. 6 and 8) formed in the axial end portions of the partition 306.

As shown in FIGS. 5 and 7, the developer conveyance members 304 and 305 slightly project beyond the end of the development roller 302 on the proximal side FS to secure supply of the developer 320 from the supply compartment 304*a* to the proximal end portion of the development roller 302. Additionally, the developer conveyance members 304 and 305 extend beyond the end of the development roller 302 on the distal side BS to provide a space necessary for toner supply. The longitudinal length of the developer regulator 303 is determined in accordance with the length of the development roller 302.

The openings 41 and 42 are formed in the respective longitudinal end portions of the partition 306, forming the communication portions between the two developer conveyance compartments 304*a* and 305*a*.

The developer 320 transported by the developer conveyance member 305 from the distal side BS to the proximal side FS, as indicated by arrow D2, is piled against the side wall of the casing 301 in the downstream end portion in that direction. The developer 320 thus piled up is then brought up through the opening 41 (hereinafter also "developer-lifting opening 41") formed in the proximal end portion of the partition 306 to the supply compartment 304*a* as indicated by arrow D3. In the supply compartment 304*a*, the developer 320 is transported by the developer conveyance member 304 from the proximal side FS to the distal side BS as indicated by arrow D4.

Similarly to the collecting compartment 305*a*, the developer 320 transported by the developer conveyance member 304 in the direction indicated by arrow D4 is piled against the side wall of the casing 301 in the downstream end portion in that direction (on the distal side BS in FIGS. 6 and 8). The developer 320 thus piled up then falls through the opening 42 (hereinafter also "developer-falling opening 42") formed in the distal end portion of the partition 306 to the collecting compartment 305*a* as indicated by arrow D2.

Thus, the development device 3 includes the development roller 302, the developer conveyance members 304 and 305, and the partition 306. The development roller 302 supplies the developer 320 to the photoreceptor 1 by rotation, thus developing the electrostatic latent image formed thereon. The two developer conveyance members 304 and 305 are arranged on a side of the development roller 302 one above the other across the partition 306 dividing the supply compartment 304*a* from the collecting compartment 305*a*. The openings 41 and 42 are formed in the longitudinal end portions of the partition 306 as the communication portions. Thus, the developer circulation path is formed inside the development device 3 to circulate the developer 320 as indicated by arrows D1 through D4.

The developer conveyance members 304 and 305 agitate and transport the developer 320 in the opposite directions in parallel to the center of rotation O-302*a* of the development roller 302 (longitudinal direction of the development device 3) along the center of rotation O-304 while rotating around the center of rotation O-304 and the center of rotation O-305, respectively. The developer conveyance member 305 is positioned adjacent to the developer separation range γ where the developer 320 is separated from the development roller 302.

The configuration shown in FIGS. 2 and 3 in which the two developer conveyance members 304 and 305 are arranged vertically can reduce the lateral size of the development device 3 compared with a comparative development device 3Z (shown in FIG. 14) in which two developer conveyance members, namely, a supply screw 404 and a collecting screw 405, are arranged horizontally in a direction away from a development roller 302Z. It is to be noted that components of the comparative development device 3Z similar to those of the development device 3 according to the present embodiment are given identical reference numeral and a suffix "Z", and descriptions thereof are omitted.

Additionally, the supply compartment 304*a* is divided from the collecting compartment 305*a* by the partition 306 in the present embodiment. Therefore, the developer 320 that has been used in image development, having a reduced toner concentration, is not immediately supplied to the development roller 302 but is agitated by the developer conveyance member 305 so that toner and carrier therein can be mixed sufficiently. Accordingly, only the developer 320 having a desired toner concentration and including toner with a desired charge amount can be supplied by the developer conveyance member 304 to the development roller 302 and used in image development for attaining high image quality.

Thus, the development device 3 according to the present embodiment can attain both compactness in the horizontal direction and high image quality.

Next, toner supply to the development device 3 is described in further detail below.

Toner in the developer 320 contained in the development device 3 is consumed in image development, and accordingly toner is externally supplied to the developer 320 in the development device 3. As shown in FIGS. 6 and 8, toner is externally supplied as indicated by arrow T through the toner supply inlet 309 positioned adjacent to the end portion of the development device 3 on the distal side BS. The distal end portion of the development device 3 corresponds to the downstream end portion of the supply compartment 304*a* from which the developer is supplied to the development roller 302. Accordingly, the supplied toner is not immediately supplied to image development but can move through the developer-falling opening 42 to the collecting compartment 305*a*. In the collecting compartment 305*a*, the supplied toner is mixed with the developer 320 therein by the developer conveyance member 305 so that the concentration of toner in the developer 320 is adjusted to a predetermined or desired concentration, after which the developer 320 is supplied through the developer-lifting opening 41 to the supply compartment 304*a* and used in image development. The collecting compartment 305*a* including the developer conveyance member 305 is for collecting the developer 320 separated from the development roller 302 and transporting it, and the developer 320 is not supplied from the collecting compartment 305*a* to the development roller 302. Therefore, the developer 320 including the fresh toner supplied through the toner supply inlet 309, agitated insufficiently, that is, the concentration of toner therein is not uniform, is not supplied to image development.

The supplied toner fallen through the developer-falling opening 42 to the collecting compartment 305*a* is transported by the developer conveyance member 305 to the proximal side FS as indicated by arrow D2 while being mixed with the developer 320 separated from the development roller 302, in which the concentration of toner is reduced. Thus, while being transported to the downstream end portion of the collecting compartment 305*a*, which is on the proximal side FS of the development device 3, the mixture of the supplied toner and the developer 320 in which the concentration of toner is reduced can be adjusted to have a proper toner concentration. Then, the developer 320 is transported through the developer-lifting opening 41 to the supply compartment 304*a*. In the supply compartment 304*a*, the developer conveyance member 304 supplies the developer 320 to the development roller 302 while transporting it to the distal side BS as indicated by arrow D4.

Next, the toner concentration detector 201 is described below.

As shown in FIGS. 6 and 8, the development device 3 includes the toner concentration detector 201 configured to detect the concentration of toner in the developer in a detection area (a detection position 201*a* shown in FIG. 6 or adjacent portion) beneath the developer-lifting opening 41 formed in the collecting compartment 305*a*. The toner concentration detector 201 according to the present embodiment is a magnetic permeability detector and can detect the concentration of carrier in developer. The concentration of toner in the developer can be obtained by deducting the concentration of carrier from 100. The controller can determine whether or not the concentration of toner in the developer 320 in the detection area of the toner concentration detector 201 is proper based on the concentration of carrier detected by the toner concentration detector 201.

The toner concentration detector 201 can be positioned beneath the developer-lifting opening 41. The toner concentration detector 201 may be attached to the outer side of the casing 301 or positioned so that a detection face thereof is partly inside the casing 301.

Next, the relation between changes in developer conveyance velocity and apparent magnetic permeability of developer is described below.

The developer conveyance member may be driven at high rotational frequency in compact development devices, whereas there are image forming apparatuses that use multiple different processing velocities, that is, quantity of copies per minute (CPM). In image forming apparatuses capable of image formation of, for example, both 30 CPM and 10 CPM, the rotational frequency of the developer conveyance member is changed in accordance with CPM. If the rotational frequency is simply proportional to CPM, the difference is tripled in this example. It is preferred to detect the toner concentration reliably under both of the different rotational frequencies. That is, in development devices in which the developer conveyance member is rotated at multiple rotational frequencies significantly different, it is preferred to reduce the degradation in the toner concentration detection capability caused by the difference in the rotational frequency.

Typically, as the developer conveyance member rotates, the conveyance blade thereof pushes downstream the developer positioned downstream from the conveyance blade. Accordingly, while the conveyance blade rotates, airspace where no developer is present is created upstream from the conveyance blade, reducing the apparent powder density of the developer. When the rotation of the conveyance blade is slowed, the airspace upstream from the conveyance blade increases in size, reducing the density of the developer in the detection area of the toner concentration detector.

Magnetic permeability of developer is dependent on the density of the developer. Accordingly, the output from the magnetic permeability detector changes as the apparent powder density (airspace ratio) of developer in the detection area. Consequently, even if the ratio of toner to carrier in the developer is the same, the apparent magnetic permeability changes when the rotational frequency of the developer conveyance member is changed, and the magnetic permeability detected by the toner concentration detector decreases.

In view of the foregoing, specific features of the development device 3 in the present embodiment are described below.

Figure 10:
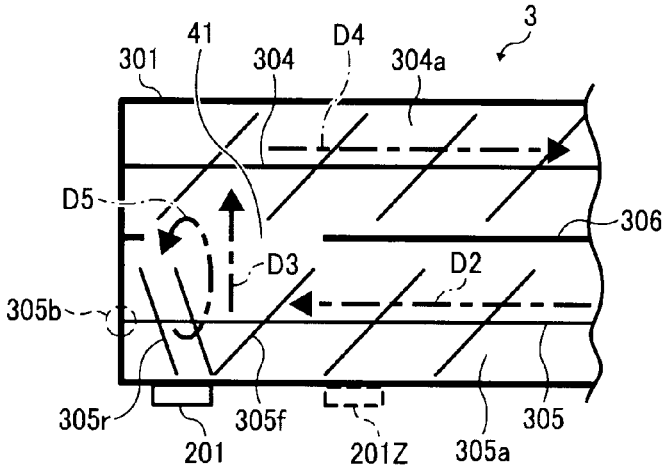
FIG. 10 is a schematic enlarged view illustrating a developer-lifting opening and adjacent portion thereof.

FIG. 10 is an enlarged view illustrating the developer-lifting opening 41 and the adjacent area on the proximal side FS in the longitudinal direction of the development device 3. In FIG. 10, broken rectangle given reference character "201Z" represents a location of a toner concentration detector in a comparative example, and the location of the toner concentration detector 201 according to the present embodiment is indicated by solid lines.

In the present embodiment, the toner concentration detector 201 is disposed beneath the developer-lifting opening 41 (communication portion) in the collection compartment 305*a* (lower compartment) so that accuracy of toner concentration detection can be improved using compression force to bring up the developer.

The developer beneath the developer-lifting opening 41 is pushed up by the developer transported from behind and reaches the height of the developer-lifting opening 41 in the partition 306. As the developer is thus compressed, even if the rotation of the developer conveyance member 305 increases and the airspace positioned upstream from the spiral blade becomes larger, the compressed developer moves to fill the airspace.

With this configuration, changes in the powder density of the developer at the toner concentration detection position 201*a* (shown in FIG. 6) of the toner concentration detector 201 can be controlled, and decreases in the density of the developer can be inhibited even if rotation of the developer conveyance member 305 becomes faster. Therefore, even if the rotational velocity of the developer conveyance member changes, changes in the density of the developer in the detection area can be inhibited. Accordingly, toner concentration detection using a magnetic permeability detector can be reliable.

It is to be noted that, although the description above concerns configurations using a screw as the developer conveyance member, in configurations using a developer conveyance member configured otherwise, changes in the density of the developer beneath the communication opening is limited because the developer is compressed similarly. Therefore, disposing the toner concentration detection area beneath the communication opening can inhibit changes in the density of the developer in the detection area even if the rotational velocity of the developer conveyance member changes.

Additionally, as shown in FIG. 10, the developer conveyance member 305 provided in the collecting compartment 305*a* includes a forward spiral blade 305*f* winding in a normal direction and a reversed spiral blade 305*r* winding in the reverse direction. The reversed spiral blade 305*r* is positioned downstream from the forward spiral blade 305*f* in the direction indicated by arrow D2, in which the forward spiral blade 305*f* transports developer. The developer 320 that has reached the downstream end portion of the collecting compartment 305*a* in that direction accumulates adjacent to the developer-lifting opening 41 and is pressed by the conveyance force generated by the developer conveyance member 305. Then, the compression force causes the developer 320 to move through the developer-lifting opening 41 as indicated by arrow D3 to the supply compartment 304*a*. Accordingly, the developer 320 positioned adjacent to the developer-lifting opening 41 is compressed and dense.

Additionally, the screw pitch of the reversed spiral blade 305*r*, which is an extreme downstream portion of the developer conveyance member 305, is shorter than that of the forward spiral blade 305*f*, and the developer conveyance velocity of the reversed spiral blade 305*r* is lower than that of the other portion. Consequently, the density of developer is higher in the portion where the reversed spiral blade 305*r* is provided and beneath the developer-lifting opening 41 than the portion where the forward spiral blade 305*f* is provided. Thus, toner concentration detection in that portion can be reliable.

Additionally, in the configuration in which the developer conveyance member 305 transports the developer 320 to the left in FIGS. 6 and 10 and compresses the developer 320 adjacent to the developer-lifting opening 41, the pressure to a bearing 305*b* of the developer conveyance member 305 can be higher, and excessive pressure to the bearing 305*b* might cause leakage of toner. Providing the reversed spiral blade 305*r* to the developer conveyance member 305 can reduce the pressure to the bearing 305*b*.

In the area where the reversed spiral blade 305*r* is provided, the developer 320 is transported to the right in FIG. 10 by the reversed spiral blade 305*r* and then is brought up by the pressure of the developer 320. As indicated by arrow D5, the developer 320 thus brought up partly falls down to the area where the reversed spiral blade 305*r* is provided. While this movement is repeated, the developer 320 present in that area can be mixed with other developer 320. Thus, in the configuration in which the toner concentration detector 201 is configured to detect the concentration of toner in the developer in the area where the reversed spiral blade 305*r* is provided, accuracy of toner concentration detection can be high constantly.

Relative positions of the reversed spiral blade 305*r* and the developer-lifting opening 41 are described in further detail below.

When the reversed spiral blade 305*r* is positioned closer to the bearing 305*b* than the developer-lifting opening 41 in the axial direction, the reversed spiral blade 305*r* can reduce the pressure from developer to the bearing 305*b*. Meanwhile, it is preferred that the developer 320 be replaced in the detection area of the toner concentration detector 201, and accordingly the detection area is positioned beneath the developer-lifting opening 41. Since the area where the reversed spiral blade 305*r* is provided serves as the toner concentration detection area, the reversed spiral blade 305*r* is provided beneath the developer-lifting opening 41. In other words, a downstream end of the developer-lifting opening 41 in the conveyance direction of the developer conveyance member 305 (indicated by arrow D2) is positioned above the reversed spiral blade 305*r*. With this arrangement, reduction in the pressure to the bearing 305*b* can consist with reliable toner concentration detection.

To examine the relation between the accuracy in toner concentration detection and location of the toner concentration detector 201, an experiment was performed.

In the experiment, outputs from a magnetic permeability sensor, serving as the toner concentration detector 201, were compared between the present embodiment (configuration 1) and a comparative example (configuration 2) in which the toner concentration detector 201Z (broken lines shown in FIG. 10) was positioned beneath the developer conveyance member 305 and upstream from an upstream end of the developer-lifting opening 41 in the conveyance direction of the developer conveyance member 305.

In the experiment, the developer conveyance member 305 was rotated at two different velocities: a high velocity of 1400 rpm and a low velocity of 500 rpm, and the concentration of toner in developer was adjusted to 4%, 7%, and 10%. Table 1 shows the results of the experiment, and FIG. 11 is a graph illustrating the results shown in Table 1.

TABLE 1

| Toner concentration | Configuration 1 Low velocity | Configuration 1 High velocity | Configuration 2 Low velocity | Configuration 2 High velocity |
|---|---|---|---|---|
| 4% | 4.03 V | 3.99 V | 4.52 V | 3.26 V |
| 7% | 2.87 V | 2.9 V | 3.61 V | 2.5 V |
| 10% | 2.35 V | 2.33 V | 3.06 V | 2.11 V |

Figure 11:
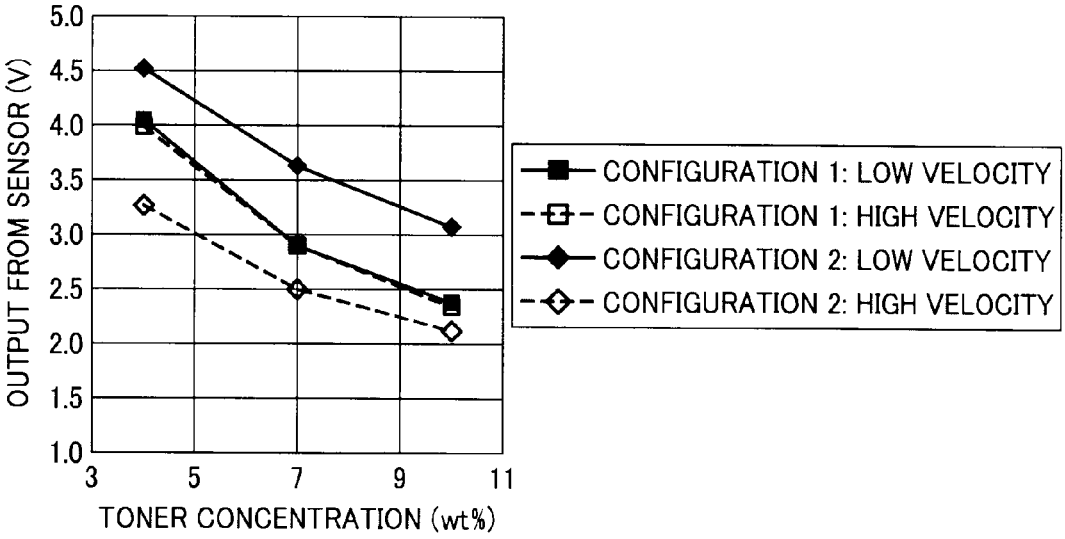
FIG. 11 is a graph of outputs from a magnetic permeability detector in an embodiment and a comparative example.

Referring to FIG. 11, in the configuration 2 (comparative example), as the rotational frequency of the conveyance screw was changed, the output from the magnetic permeability sensor changed as much as 1 volt in each of three different toner concentrations. The following factors can be assumed to have caused changes in the output from the magnetic permeability sensor.

As the rotational frequency of the conveyance screw increases, a layer of air positioned on the back of the blade of the conveyance screw becomes thicker. Accordingly, the air-space ratio increases, and the density of developer during driving is reduced. When the apparent density of developer decreases as the rotational frequency of the conveyance screw increases, the apparent magnetic permeability decreases accordingly, resulting in the decrease in the output from the magnetic permeability sensor, which measures the apparent magnetic permeability of developer.

By contrast, in the configuration 1 according to the present embodiment, the output from the magnetic permeability sensor was similar even when the rotational frequency was increased. In the configuration 1, almost no layer of air is present in the area where the reversed spiral blade 305*r* is provided, and the airspace ratio hardly increases even when the conveyance screw rotates at a hither velocity. In the area where the reversed spiral blade 305*r* is provided, even when the conveyance screw rotates at a high velocity, increasing the developer conveyance velocity, some developer does not pass through the developer-lifting opening 41 but falls. Therefore, the increase in the airspace ratio is limited.

Referring to FIG. 11, in the configuration 1, the voltage (hereinafter "input voltage Vc1") inputted to the magnetic permeability sensor (toner concentration detector 201) for "high velocity" and that for "low velocity" were the same or similar. Similarly, in the configuration 2, the voltage (hereinafter "input voltage Vc2") inputted to the magnetic permeability sensor (toner concentration detector 201Z) for "high velocity" and that for "low velocity" were the same or similar. However, the input voltage Vc1 and the input voltage Vc2 are different, and thus comparing the magnitude of the output from the magnetic permeability sensor would be pointless.

Detection sensitivity in response to changes in toner concentration in the configurations 1 and 2 is described below.

In FIG. 11, the inclination of the graph represents changes in the output from the magnetic permeability sensor in response to changes in toner concentration, and the inclination of the graph of the configuration 1 is greater than that of the configuration 2. In other words, in the configuration 1, the changes in the output from the magnetic permeability sensor in response to changes in toner concentration is greater. Thus, the configuration 1 can attain more accurate detection of the toner concentration in response to changes in toner concentration or developer conveyance velocity caused by changes in the rotational frequency of the developer conveyance member 305 provided in the collecting compartment 305*a*.

Figure 12:
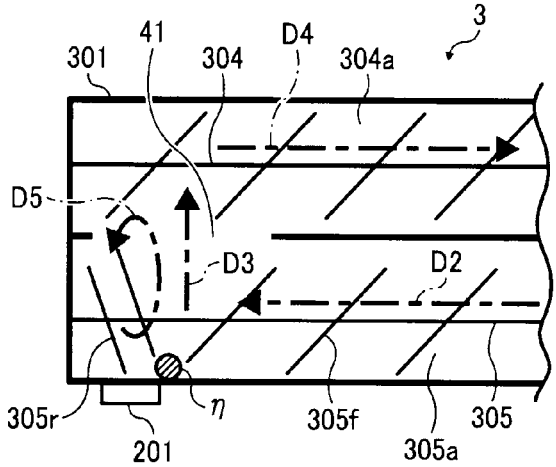
FIG. 12 is an enlarged view illustrating a developer-lifting opening and the adjacent area in a configuration in which a forward spiral blade and a reversed spiral blade of a developer conveyance member are away from each other.

FIG. 12 is an enlarged partial view of another comparative example in which the forward spiral blade 305*f* and the reversed spiral blade 305*r* of the developer conveyance member 305 are away from each other. When the forward spiral blade 305*f* and the reversed spiral blade 305*r* are positioned across a gap as shown in FIG. 12, that is, there is no spiral blade to apply a conveyance force to the developer 320 in the gap, the developer 320 in the gap is moved by the force from upstream and downstream in the developer conveyance direction. However, in an area η adjacent to the casing 301 facing the area where no spiral blade is provided, the force applied to the developer 320 from upstream and downstream in the developer conveyance direction is insufficient, allowing the developer 320 to stay there.

If the developer 320 is retained in the area η, while the concentration of toner in the developer 320 inside the development device 3 changes, the developer 320 adjacent to the detection area of the toner concentration detector 201 can have a toner concentration different from that of the developer 320 circulating inside the development device 3. Even when the concentration of toner in the developer 320 inside the development device 3 has been increased, for example, from 4% to 7%, it is possible that the developer 320 having a toner concentration of 4% is present adjacent to the toner concentration detection area. Even if the developer 320 having a toner concentration of 4% is not present in the toner concentration detection area, it is possible that the toner concentration detector can detect the concentration of toner in the developer that has been retained in the adjacent area and transported to the toner concentration detection area. In such a case, the toner concentration detected is different from that of the developer circulating inside the development device 3. In this case, the concentration detected is lower than the developer circulating inside the development device 3. If the detected toner concentration is lower than that of the developer circulating inside the development device 3, the concentration of toner cannot be adjusted properly because toner is supplied according to the detected toner concentration.

In view of the foregoing, it is preferable to prevent the developer 320 from being retained in the toner concentration detection area adjacent to the detection position of the toner concentration detector 201. Therefore, the forward spiral blade 305*f* and the reversed spiral blade 305*r* are continuous with each other. This configuration can eliminate or reduce an area where no conveyance force is applied to the developer between the forward spiral blade 305*f* and the reversed spiral blade 305*r*, such as the area η shown in FIG. 12, thus preventing accumulation of developer adjacent to the toner concentration detection position 201*a*. Consequently, error or margin of detection of toner concentration can be reduced.

Figure 14:
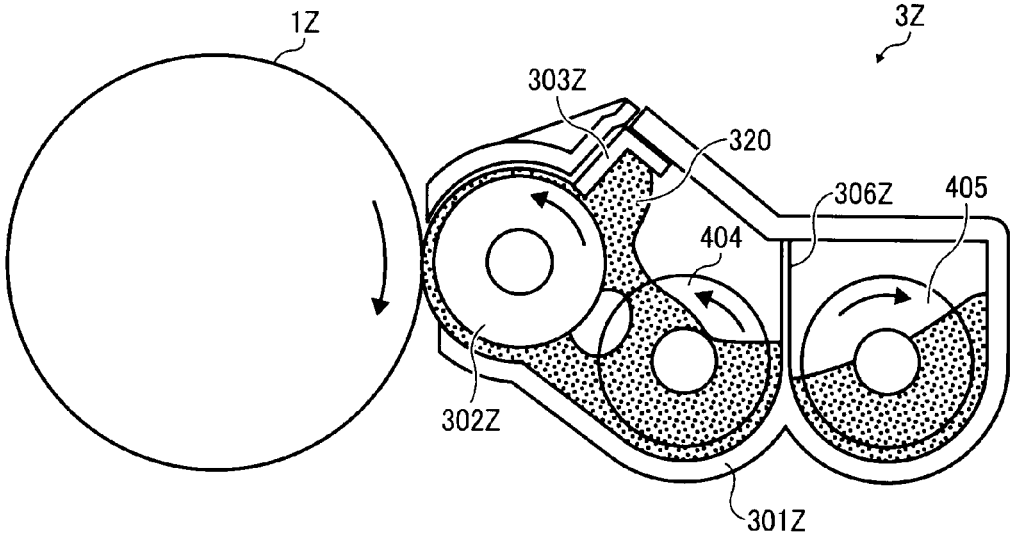
FIG. 14 is a comparative development device in which two developer conveyance members are arranged in a direction away from a development roller.

The above-described arrangement in which the toner concentration detection position is adjacent to the reversed spiral blade portion is not suitable to a configuration, such as shown in FIG. 14, in which two developer conveyance members are arranged horizontally. In the development device 3 according to the present embodiment, as shown in FIG. 10, the developer 320 falls from above to the area where the reversed spiral blade 305*r* is provided, and accordingly the concentration of toner in the developer 320 adjacent to the reversed spiral blade 305*r* can be similar to that of the developer 320 circulating inside the development device 3. By contrast, in the development device 3Z shown in FIG. 14, even if the reversed spiral blade 305*r* is provided adjacent to the downstream end portion in the developer conveyance of the conveyance screw 405, developer does not fall to the reversed spiral blade portion. Accordingly, the developer is retained there. The developer thus retained has a toner concentration different from that of the developer circulated inside the development device 3Z, and hinders proper detection of the concentration of toner in the developer inside the development device 3Z.

Therefore, the above-described arrangement in which the toner concentration detection area is positioned adjacent to the reversed spiral blade portion 305*r* is effective when the two developer conveyance members 304 and 305 are disposed so that an angle formed by a horizontal line and a line passing through the centers of rotation O-304 and O-305 of the developer conveyance members 304 and 305 is greater than an angle of rest at which the developer 320 falls under its own weight.

Figure 13:
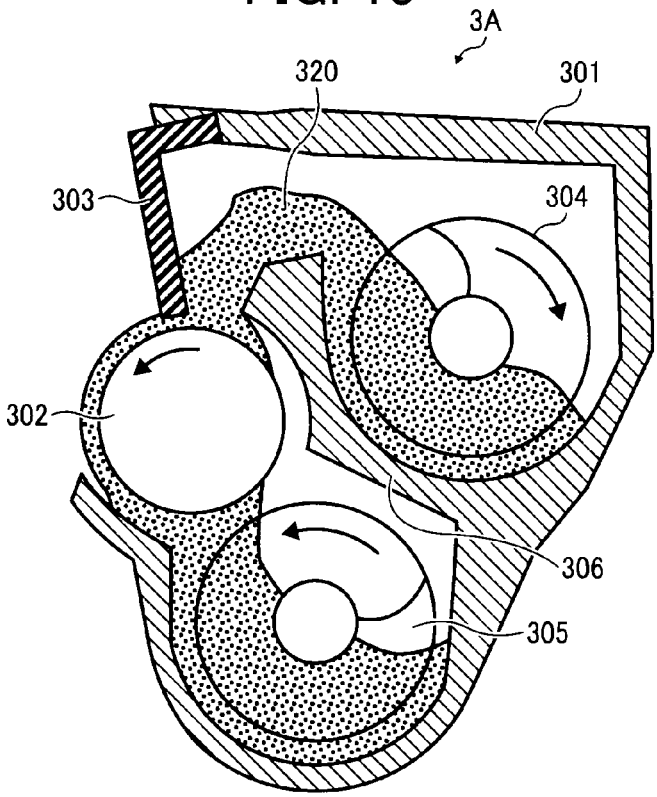
FIG. 13 is a development device in which two developer conveyance members are positioned obliquely.

Therefore, the above-described arrangement according to the present embodiment can be also effective in a development device 3A shown in FIG. 13, in which developer conveyance members 304 and 305 are arranged obliquely to a vertical line, close to a vertical arrangement.

As described above, the development device 3 according to the present embodiment includes the casing 301, the developer conveyance members 304 and 305, and the toner concentration detector 201. The development roller 302 serves as a developer bearer that carries by rotation two-component developer including toner and magnetic carrier and supplies the developer to the latent image formed on the photoreceptor 1, serving as a latent image bearer, in the development range facing the photoreceptor 1. The casing 301 serves as a developer container for containing the developer supplied to the development roller 302, and the developer conveyance members 304 and 305 transport the developer inside the casing 301. Additionally, the toner concentration detector 201 detects the ratio of toner in the developer adjacent to the toner concentration detection position 201*a* disposed inside the casing 301. The interior of the casing 301 is divided by the partition 306, at least partly, into multiple developer conveyance paths (i.e., the supply compartment 304*a* and the collecting compartment 305*a*), and the developer conveyance members 304 and 305 are arranged one above the other via the partition 306. Additionally, the developer-lifting opening 41 is formed, as the communication portion, in the downstream end portion of the partition 306 in the direction in which the developer inside the collecting compartment 305*a* is conveyed. Thus, the developer is transported from the downstream end portion of the collecting compartment 305*a* to the supply compartment 304*a* through the developer-lifting opening 41. The toner concentration detection position 201*a* is positioned beneath the developer-lifting opening 41 in the collecting compartment 305*a*.

Additionally, the developer conveyance member 305 includes a conveyance blade oblique to the axial direction, such as the spiral blade winding around the rotary shaft or multiple discontinuous fins, and the reversed blade (reversed spiral 305*r* or reversed fins) is provided in the downstream end portion of the developer conveyance member 305 in the developer conveyance direction. The direction of the reversed spiral blade 305*r* is opposite the winding direction of the forward spiral blade 305*f*. Although the upward compression force is applied to the developer in the downstream end portion of the collecting compartment 305*a*, which might cause the developer to leak from the bearing 305*b*, the reversed spiral blade 305*r* can reduce the pressure to the bearing 305*b*. Thus, leakage of toner can be prevented.

The toner concentration detection position 201*a* is positioned beneath the developer-lifting opening 41 in the collecting compartment 305*a* and facing the reversed spiral blade 305*r*. The developer is retained in the area where the reverse screw portion 305*r* is provided, and it can inhibit decreases in the apparent powder density of the developer (increases in airspace ratio) caused by the increase in the rotational frequency of the developer conveyance member. Accordingly, disposing the toner concentration detection position 201*a* in this area can facilitate reliable toner concentration detection.

Additionally, the downstream end portion of the developer-lifting opening 41 (communication portion) in the direction in which the developer conveyance member 305 transports the developer is positioned above the reversed spiral blade 305*r* of the developer conveyance member 305. Depending on the relative positions of the developer-lifting opening 41 and the reversed spiral blade 305*r*, it is possible that the movement of developer is stopped adjacent to the reversed spiral blade 305*r*. If the developer is thus retained adjacent to the reversed spiral blade 305*r* and the toner concentration thereof changes from that of the developer circulating inside the development device 3, it is difficult to detect the toner concentration properly. Further, setting their relative positions properly can secure the capability of the reversed spiral blade 305*r* to reduce the pressure to the bearing 305*b* from the developer. In the development device 3 according to the above-described embodiment, the toner concentration detection position 201*a* is positioned in an area where the developer-lifting opening 41 overlaps with the reversed spiral blade 305*r* in the axial direction of the developer conveyance member 305. With this configuration, reduction in the pressure to the bearing 305*b* can consist with reliable toner concentration detection.

Additionally, the image forming apparatus 100 according to the present embodiment includes the photoreceptor 1 serving as the latent image bearer, the charger 2 to charge the photoreceptor 1, the development device 3 to develop a latent image formed on the photoreceptor 1, the cleaning unit 6 to remove toner remaining on the photoreceptor 1 after image transfer, and the toner concentration detector 201. The image forming apparatus 100 can form satisfactory images because the concentration of toner in the developer inside the development device 3 can be detected reliably.

Additionally, at least the photoreceptor 1 and the development device 3 can be housed in a common unit casing of the image forming unit 17, which is a modular unit removably installable in the image forming apparatus 100. This configuration can facilitate replacement of the development device 3.

Numerous additional modifications and variations are possible in light of the above teachings. It is therefore to be understood that, within the scope of the appended claims, the disclosure of this patent specification may be practiced otherwise than as specifically described herein.

What is claimed is:

1. A development device comprising:

a developer container for containing two-component developer;

a developer bearer to carry by rotation the developer contained in the developer container to a development range facing a latent image bearer;

a partition dividing at least partly the developer container into an upper compartment and a lower compartment arranged vertically;

an upper developer conveyance member disposed in the upper compartment to transport the developer inside the upper compartment;

a lower developer conveyance member disposed in the lower compartment to transport the developer inside the lower compartment;

a communication portion through which the developer moves from the lower compartment to the upper compartment, the communication portion disposed in a downstream end portion of the lower compartment in a direction in which the lower developer conveyance member transports the developer; and a toner concentration detector to detect a concentration of toner in the developer beneath the communication portion inside the lower compartment, the toner concentration detector being positioned directly beneath the communication portion with respect to a vertical direction and a longitudinal direction, and the toner concentration detector being positioned beneath the lower developer conveyance member.

2. The development device according to claim 1, wherein the lower developer conveyance member comprises a rotary shaft and a spiral blade winding around the rotary shaft, the spiral blade including a forward spiral portion and a reversed spiral portion winding in a direction opposite to a direction in which the forward spiral portion winds around the rotary shaft, and the reversed spiral portion is positioned in a downstream end portion of the lower developer conveyance member in the direction in which the lower developer conveyance member transports the developer.

3. The development device according to claim 2, wherein the toner concentration detection position is disposed facing the reversed spiral portion of the lower developer conveyance member.

4. The development device according to claim 2, wherein the forward spiral portion and the reversed spiral portion of the spiral blade of the lower developer conveyance member are continuous with each other.

5. The development device according to claim 2, wherein an end portion of the communication portion in the direction in which the lower developer conveyance member transports the developer is positioned above the reversed spiral portion of the spiral blade of the lower developer conveyance member.

6. The development device according to claim 2, wherein the upper developer conveyance member comprises a rotary shaft and a spiral blade winding around the rotary shaft.

7. The development device according to claim 2, wherein, beneath the communication portion in a longitudinal direction of the development device, the reversed spiral portion and the forward spiral portion are disposed.

8. The development device according to claim 7, wherein the toner concentration detector faces the reversed spiral portion and does not face the forward spiral portion.

9. The development device according to claim 1, wherein the toner concentration detector is a magnetic permeability detector to detect an apparent magnetic permeability of the developer inside the developer container.

10. The development device according to claim 1, wherein the toner concentration detector comprises a detection face disposed inside the lower compartment and beneath the communication portion between the upper compartment and the lower compartment.

11. The development device according to claim 1, wherein the toner concentration device is attached to an outer side of the developer container.

12. The development device according to claim 1, wherein the lower developer conveyance member comprises a rotary shaft and a spiral blade winding around the rotary shaft, the spiral blade including a forward spiral portion and a reversed spiral portion winding in a direction opposite to a direction in which the forward spiral portion winds around the rotary shaft, wherein the reversed spiral portion is positioned in a downstream end portion of the lower developer conveyance member in the direction in which the lower developer conveyance member transports the developer, and wherein the reversed spiral portion is positioned beneath and within a width of the communication portion in a longitudinal direction of the development device, the longitudinal direction being a direction in which the lower developer conveyance member transports the developer.

13. An image forming apparatus comprising:

a latent image bearer on which a latent image is formed; and a development device to develop the latent image formed on the latent image bearer, the development device including:

a developer container for containing two-component developer, a developer bearer to carry by rotation the developer contained in the developer container to a development range facing a latent image bearer, a partition dividing at least partly the developer container into an upper compartment and a lower compartment arranged vertically, an upper developer conveyance member disposed in the upper compartment to transport the developer inside the upper compartment, a lower developer conveyance member disposed in the lower compartment to transport the developer inside the lower compartment, a communication portion through which the developer moves from the lower compartment to the upper compartment, the communication portion disposed in a downstream end portion of the lower compartment in a direction in which the lower developer conveyance member transports the developer, and a toner concentration detector to detect a concentration of toner in the developer beneath the communication portion inside the lower compartment, the toner concentration detector being positioned directly beneath the communication portion with respect to a vertical direction and a longitudinal direction, and the toner concentration detector being positioned beneath the lower developer conveyance member.

14. A process cartridge removably installable in an image forming apparatus, the process cartridge comprising:

a latent image bearer on which a latent image is formed; and a development device to develop the latent image formed on the latent image bearer, the development device including:

a developer container for containing two-component developer, a developer bearer to carry by rotation the developer contained in the developer container to a development range facing a latent image bearer, a partition dividing at least partly the developer container into an upper compartment and a lower compartment arranged vertically, an upper developer conveyance member disposed in the upper compartment to transport the developer inside the upper compartment, a lower developer conveyance member disposed in the lower compartment to transport the developer inside the lower compartment, a communication portion through which the developer moves from the lower compartment to the upper compartment, the communication portion disposed in a downstream end portion of the lower compartment in a direction in which the lower developer conveyance member transports the developer, and a toner concentration detector to detect a concentration of toner in the developer beneath the communication portion inside the lower compartment, the toner concentration detector being positioned directly beneath the communication portion with respect to a vertical direction and a longitudinal direction, and the toner concentration detector being positioned beneath the lower developer conveyance member.

* * * * *